United States Patent [19]

Feldstein

[11] 3,962,495

[45] June 8, 1976

[54] METHOD OF MAKING DUPLICATES OF OPTICAL OR SOUND RECORDINGS

[75] Inventor: Nathan Feldstein, Kendall Park, N.J.

[73] Assignee: RCA Corporation, New York, N.Y.

[22] Filed: Jan. 2, 1975

[21] Appl. No.: 537,846

Related U.S. Application Data

[63] Continuation of Ser. No. 304,595, Nov. 8, 1972, abandoned, which is a continuation-in-part of Ser. No. 862,019, Sept. 29, 1969, abandoned.

[52] U.S. Cl. ..... 427/306; 106/1; 264/1; 264/220; 425/810

[51] Int. Cl.[2] ..... C23C 3/02

[58] Field of Search ..... 427/304, 305, 306, 437, 427/438; 264/220

[56] References Cited

UNITED STATES PATENTS

| | | | |
|---|---|---|---|
| 3,431,120 | 3/1969 | Weisenberger | 427/306 |
| 3,438,798 | 4/1969 | Baudrand et al. | 427/306 X |
| 3,441,428 | 4/1969 | Reinhard et al. | 427/306 |

FOREIGN PATENTS OR APPLICATIONS

| | | | |
|---|---|---|---|
| 1,078,439 | 8/1967 | United Kingdom | 427/306 |
| 1,003,575 | 9/1965 | United Kingdom | 427/306 |

OTHER PUBLICATIONS

Schwartz, Technical Proceedings of the American Electroplaters Soc. 47 (1960) pp. 176, 179, 183.

*Primary Examiner*—Ralph S. Kendall
*Attorney, Agent, or Firm*—Glenn H. Bruestle; Arthur E. Wilfond; William S. Hill

[57] ABSTRACT

Method of making duplicate copies of information recorded in an organic plastic material as minute surface relief patterns, comprising sensitizing and activating the patterned surface, depositing a thin layer of nickel or cobalt utilizing a room temperature autocatalytic deposition process, backing up the thin metal layer with a heavier electrolytic metal deposit, separating the initial nickel or cobalt surface from the plastic surface and using the metal replica to mold or press duplicate copies in a deformable plastic.

9 Claims, No Drawings

METHOD OF MAKING DUPLICATES OF OPTICAL OR SOUND RECORDINGS

This application is a continuation of application Ser. No. 304,595 filed Nov. 8, 1972 now abandoned, which is a continuation-in-part of application Ser. No. 862,019 filed Sept. 29, 1969 now abandoned.

BACKGROUND OF THE INVENTION

This invention more particularly relates to the recording and replication of audio and/or video information. Specifically, it deals with audio or video information recorded as a relief pattern in a suitable polymer material, the formation of a metal master from the original recording and the hot stamping or embossing of the pattern in a suitable deformable plastic medium.

A commonly-used method of making many duplicates of a sound recording is to convert the sound vibrations into corresponding surface undulations or deformations in a soft, deformable surface such as a layer of lacquer on a supporting aluminum disc, replicate the undulations in a harder metal surface, and then use the metal replica to mold sound tracks into synthetic resin discs. The sound can then be reproduced on a phonograph with the aid of a pick-up unit.

Several methods for recording optical images as relief patterns in a surface have been devised. One such method involves the use of electrostatically charged, heat deformable, photoconductive recording elements with which so-called deformation images are prepared. These can be read out by special optical techniques, such as Schlieren optics. A second method involves the recording in, e.g. a photoresist film, of phase holograms consisting of ripples in an otherwise smooth surface. A third technique employs a modulated groove in which the modulation is an analog of the electrical signal provided, for instance, to a television receiver.

A common feature in each of these three approaches is that the optical information is contained in a relief pattern formed in an otherwise smooth surface or in an unmodulated groove. Replicas of these relief patterns can be formed by techniques similar to those employed in the production of phonograph records.

Examining the usual method of making duplicate sound recordings (i.e., phonograph records) in somewhat greater detail, after the sound track has been cut into a nitrocellulose lacquer surface with a vibrating cutting stylus, the surface is prepared for deposition of nickel which is to comprise the master from which stampers are made. This preparatory treatment includes suitably sensitizing the surface and then depositing a thin layer of silver by chemical reduction so that a conductive base is formed. Nickel is then deposited electrolytically on the condutive base. Electrolytic deposition baths usually operate best at elevated temperatures, for example, 50° C.

After the nickel has been deposited to suitable thickness, the assembly is separated at the interface between the silver layer and lacquer substrate. A nickel and/or chromium layer is commonly deposited on the silver. As a result, this surface is not a completely faithful reproduction of the original lacquer surface; some degradation of the original recording has been introduced. Silver, rather than nickel, is deposited initially because most electroless* nickel plating baths, which might conceivably be used to deposit metal on the lacquer surface, operate satisfactorily only at temperatures of at least 70° C. Such temperatures cause undesirable physical or chemical changes in lacquers.

*"electroless" is a term commonly applied to autocatalytic chemical plating taking place on a suitable surface.

In accordance with the present invention, it has now been found that the silvering step can be eliminated entirely in the making of metal replications of plastic surfaces. The initial deposition of metal on the modulated plastic surface can be carried out by autocatalytic chemical plating of nickel or cobalt at or slightly above room temperature, the thickness of the initial metal deposit being dependent upon immersion time in the electroless solution. The deposits are uniform and fine-grained. Moreover, although the positive photoresists cited as examples herein are known to be attacked by alkaline media, the alkaline electroless deposition baths used in the present invention do not cause detectable degradation of the photoresist surface. As a result, a faithful reproduction of the original recording is obtained.

A prior art replication process which purported to eliminate the silvering step and substitute a nickel layer in the metal replication of plastic surfaces was described in British Pat. No. 1,078,439 published Aug. 9, 1967. This involves a homogeneous as well as a heterogeneous process rather than just a heterogeneous (surface nucleated) process, and involves making up separate solutions of a nickel salt and a reducing agent, such as sodium borohydride, stabilized with sodium hydroxide. The two solutions are mixed either during the deposition process or just prior thereto. This mixture is not stable at room temperature and nickel begins to precipitate as a dark colloidal cloud as soon as the two solutions are combined. Moreover, the plating deposit is grainy and not sufficiently adherent to a smooth surface to permit easy build up of an electrolytic metal layer.

EXAMPLE I

As an example of how the method of the present invention may be applied, replication of a relief pattern in a positive photoresist will be described. The photoresist may be one marketed by Eastman Kodak Company and known as KAR-3 or one marketed by Shipley Company and known as AZ-1350. The relief pattern is formed in the photoresist surface by suitable exposure and development steps. In the case of the AZ-1350, the manufacturer recommends an aqueous alkaline developer.

The first step in making a metal replica of the relief patterned plastic surface is to clean the surface and modify it chemically so that it will be sufficiently hydrophilic for subsequent processing. A brief immersion in 30% $HNO_3$ is usually sufficient for this purpose.

The next step is to sensitize the cleaned surface so that nuclei of an activating metal will be formed on the surface during a subsequent step. After thoroughly rinsing the surface with water, the surface is treated with a tin chloride sensitizing solution. For many applications a satisfactory sensitizing solution can be prepared by mixing 70 g/l $SnCl_2.2H_2O$ and 40 cc/l conc. HCl in water. For sensitizing positive photoresist surfaces, the following composition has been found especially satisfactory. First, a solution is made up of 1 part (by vol.) $SnCl_2.2H_2O$ and 1 part (by vol.) conc. HCl, 75 ml; concentrated $NH_4OH$ (58% by wt.), 40 ml; deionized water, 40 ml. This solution should have a pH of about 1.5. To this solution, 650 ml. of deionized water is added and the final pH is adjusted to 1.0–1.1 with HCl. The final solution is allowed to stand about 24 hours prior to use in order to stabilize it.

After the sensitization step is complete, the surface is treated with an activating solution which catalyzes the deposition of the metal to be deposited later. A typical activating solution may be:

| | |
|---|---|
| $PdCl_2$ | 1 gm./liter |
| Conc. HCl | 1 ml./liter |

This solution deposits palladium nuclei on the sensitized surface.

Next is the step of depositing the replicating metal layer. It has been found preferable to deposit a nickel-boron layer electrolessly from a solution that is operative at room temperature. Typical initial bath composition is

| | | |
|---|---|---|
| $NiSO_4.6H_2O$ | 8.3 | gms./liter |
| $Na_4P_2O_7.10H_2O$ | 17 | gms./liter |
| $(CH_3)_2NHBH_3$ | 0.5 | gms./liter |

Conc. $NH_4OH$ to adjust to an initial pH of about 10.3. This bath produces a uniform, adherent, electrically conductive deposit in less than 10 minutes of plating. The amount of boron present in the nickel deposit is less than 5% by weight.

In this bath and in other baths set forth herein, the $Na_4P_2O_7.10H_2O$ functions as a complexing agent for the nickel ions as described, for example, in an article by M. Schwartz entitled "The Chemical Reduction of Nickel-Phosphorus Alloys from Pyrophosphate Solutions" and published in the 47th Annual Technical Proceedings of the American Electroplating Society, P. 176 et seq. (1960).

The plating operation described above produces a thin layer of nickel that must be backed up with an additional thickness of metal to enable the metal replica to be used as a stamper or as a mold. The added thickness may be provided by immersing the unit in any of several commercially available nickel sulfamate baths such as the Barrett sulfamate nickel plating solution, type SN, sold by Allied Research Products, Inc., Detroit, Michigan. This bath operates at about 50° C and a pH of 5.5. At the start of the plating operation, the current density should be less than about 20 amps/sq.ft. Later the current density can be increased to about 45 amps/sq.ft. The thickness of the electrodeposit may be 5 to 10 mils although this will vary depending upon the application.

After separation of the nickel surface from the photoresist surface, the metal replica may be used to emboss or hot press duplicate recordings in thermoplastic discs or tapes as the case may be. Vinyl polymers and copolymers similar to those used in conventional phonograph records, are suitable recording materials. In experimental runs, up to 4000 pressings have been made from a metal master without any apparent degradation in quality of the embossed pattern.

Instead of using the metal replica, directly, in pressing copies, the surface may be passivated with potassium dichromate solution or with potassium permanganate solution, and a relatively thick nickel metal positive may be electroplated against the passivated surface. This may be separated and used to make one or more second generation "negative" nickel stampers as is customary in manufacturing phonograph records.

Although nickel-boron room temperature electroless deposition baths are preferred, room temperature nickel-phosphorus baths may also be used. A suitable nickel-phosphorus bath is as follows:

| | | |
|---|---|---|
| $NiCl_2.6H_2O$ | 7.1 | gms./liter of bath |
| $NaH_2PO_2.H_2O$ | 8.3 | gms./liter of bath |
| $Na_4P_2O_7.10H_2O$ | 17 | gms./liter of bath |
| $NH_4OH$ (58% by wt.) | 3.5 | cc./liter of bath |

This bath has an initial pH of 9.9.

EXAMPLE 2

Good metal replications can also be made using room temperature electroless cobalt deposition baths. A preferred example of this type of bath is as follows:

| | | |
|---|---|---|
| $Na_4P_2O_7.10H_2O$ | 12 | gms./liter |
| $CoSO_4.7H_2O$ | 9.1 | gms./liter |
| $NH_4OH$ (58% by wt.) | 1.3 | cc./liter |
| $(CH_3)_2NHBH_3$ | 0.3 | gms./liter |

This bath has an initial pH of 10.1.

This bath produces excellent fine-grained deposits on palladium-activated photoresists. The relief patterned plastic surface comprising the original recording is sensitized, activated and then immersed in the bath for about 10 minutes to produce a thin deposit, as in Example 1. Then an added thickness of 5 to 10 mils of nickel is deposited electrolytically from a conventional sulfamate bath to make a record master.

In this example, the dimethylamine borane is the reducing agent.

The electroless plating baths used in the present method should have a pH between about 9 and 11.

Nickel and cobalt are the primary metals intended to be deposited electrolessly upon the deformed plastic surface, but other metals such as one or more of tungsten, iron, and molybdenum may be co-deposited with each of the metals, if desired. Cobalt may also be co-deposited with nickel either as a major or minor ingredient of the electroless deposit. Co-deposits of nickel and tungsten may be formed, e.g., by incorporating sodium tungstate in the electroless nickel bath.

Another interesting application of the present process is in making metal replications of plastic surfaces containing both video and audio information. In making a video replication of a hologram replication it is often desired to have a sound track on the same surface. This may be readily accomplished using the processes of the invention.

I claim:

1. A method of replicating information recorded as a surface relief pattern on a surface of a synthetic resinous positive photoresist material of the type normally attacked by alkaline media without detectable degradation of the photoresist material, comprising:

cleaning said surface, sensitizing and activating said surface to form nuclei of an activating metal thereon, and electrolessly depositing nickel or cobalt on said activated surface by immersing said surface at substantially room temperature in a single aqueous solution containing a nickel or cobalt salt, sodium pyrophosphate, ammonium hydroxide and a reducing agent which is either an amine borane or a hypophosphite salt, said solution having a pH between about 9 and 11.

2. A method according to claim 1 in which nickel and cobalt are co-deposited.

3. A method according to claim 1 in which said surface pattern is an optical deformation image.

4. A method according to claim 1 in which said surface relief pattern is a video recording.

5. A method according to claim 1 in which said surface relief pattern is a phase hologram.

6. A method according to claim 1 in which said surface relief pattern is a sound recording.

7. The method of claim 1, wherein said bath contains 8.3 g/l of nickel sulfate, 17 g/l of sodium pyrophosphate and 0.5 g/l of dimethylamine borane.

8. The method of claim 1, wherein said bath contains 7.1 g/l of nickel chloride, 8.3 g/l of sodium hypophosite, and 17 g/l of sodium pyrophosphate.

9. The method of claim 1, wherein said bath contains 9.1 g/l of cobalt sulfate, 12 g/l sodium pyrophosphate and 0.3 g/l of dimethylamine borane.

* * * * *